US011971191B2

(12) United States Patent
Cannon

(10) Patent No.: US 11,971,191 B2
(45) Date of Patent: Apr. 30, 2024

(54) AIR CONDITIONER CONDENSER COVER

(71) Applicant: Paul Cannon, Florence, SC (US)

(72) Inventor: Paul Cannon, Florence, SC (US)

( * ) Notice: Subject to any disclaimer, the term of this patent is extended or adjusted under 35 U.S.C. 154(b) by 0 days.

(21) Appl. No.: 17/510,479

(22) Filed: Oct. 26, 2021

(65) Prior Publication Data

US 2023/0228449 A1 Jul. 20, 2023

(51) Int. Cl.
*F24F 13/20* (2006.01)
*F24F 13/08* (2006.01)

(52) U.S. Cl.
CPC ..... *F24F 13/20* (2013.01); *F24F 13/082* (2013.01)

(58) Field of Classification Search
CPC ..... F24F 1/58; F24F 1/50; F24F 13/20; F24F 13/082; F24F 1/56; F24F 1/06; E04H 15/14; E04H 15/40; E04H 15/34; E04B 1/5818; E05C 19/003; B65D 65/02; F28F 2265/02
See application file for complete search history.

(56) References Cited

U.S. PATENT DOCUMENTS

D244,293 S 5/1977 Carluccio
D702,330 S 4/2014 Holslin
9,435,561 B2 9/2016 Bowen
2005/0022853 A1* 2/2005 Scissom ..... F24F 1/58 135/156
2007/0204945 A1* 9/2007 Ross ..... F24F 1/50 150/165
2015/0338125 A1* 11/2015 Bowen ..... F24F 13/20 150/165
2016/0061483 A1* 3/2016 DeLano ..... F24F 1/58 55/507
2016/0305148 A1 10/2016 Poston
2017/0074526 A1 3/2017 Colantuoni
2019/0346160 A1 11/2019 Almaoula

OTHER PUBLICATIONS

Evans, Paul. "Density of Metals". May 18, 2015. TheEngineeringMindset.com. (https://theengineeringmindset.com/density-of-metals/) (Year: 2015).*
Family Handyman. "Covering Your Air Conditioner Condenser Unit". Sep. 16, 2021. (https://www.familyhandyman.com/project/covering-your-air-conditioner-condenser-unit/). (Year: 2021).*

* cited by examiner

*Primary Examiner* — Edelmira Bosques
*Assistant Examiner* — Brett Peterson Mallon

(57) ABSTRACT

The air conditioning condenser cover comprises a barrier structure, a plurality of weight shafts, a plurality of fastening device sets, and an air conditioner. The air conditioner further comprises an exhaust vent. The plurality of weight shafts and the plurality of fastening device sets attach the barrier structure to the exhaust vent of the air conditioner. The barrier structure forms a protected space that prevents water and debris from entering the exhaust vent of the air conditioner.

8 Claims, 4 Drawing Sheets

AIR CONDITIONER CONDENSER COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of air conditioners, more specifically, a cover for an air conditioner. (F24F13/20)

SUMMARY OF INVENTION

The air conditioning condenser cover comprises a barrier structure, a plurality of weight shafts, a plurality of fastening device sets, and an air conditioner. The air conditioner further comprises an exhaust vent. The plurality of weight shafts and the plurality of fastening device sets attach the barrier structure to the exhaust vent of the air conditioner. The barrier structure forms a protected space that prevents water and debris from entering the exhaust vent of the air conditioner.

These together with additional objects, features and advantages of the air conditioning condenser cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the air conditioning condenser cover in detail, it is to be understood that the air conditioning condenser cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the air conditioning condenser cover.

It is therefore important that the claims be regarded as including such equivalent construction insofar as they do not depart from the spirit and scope of the air conditioning condenser cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
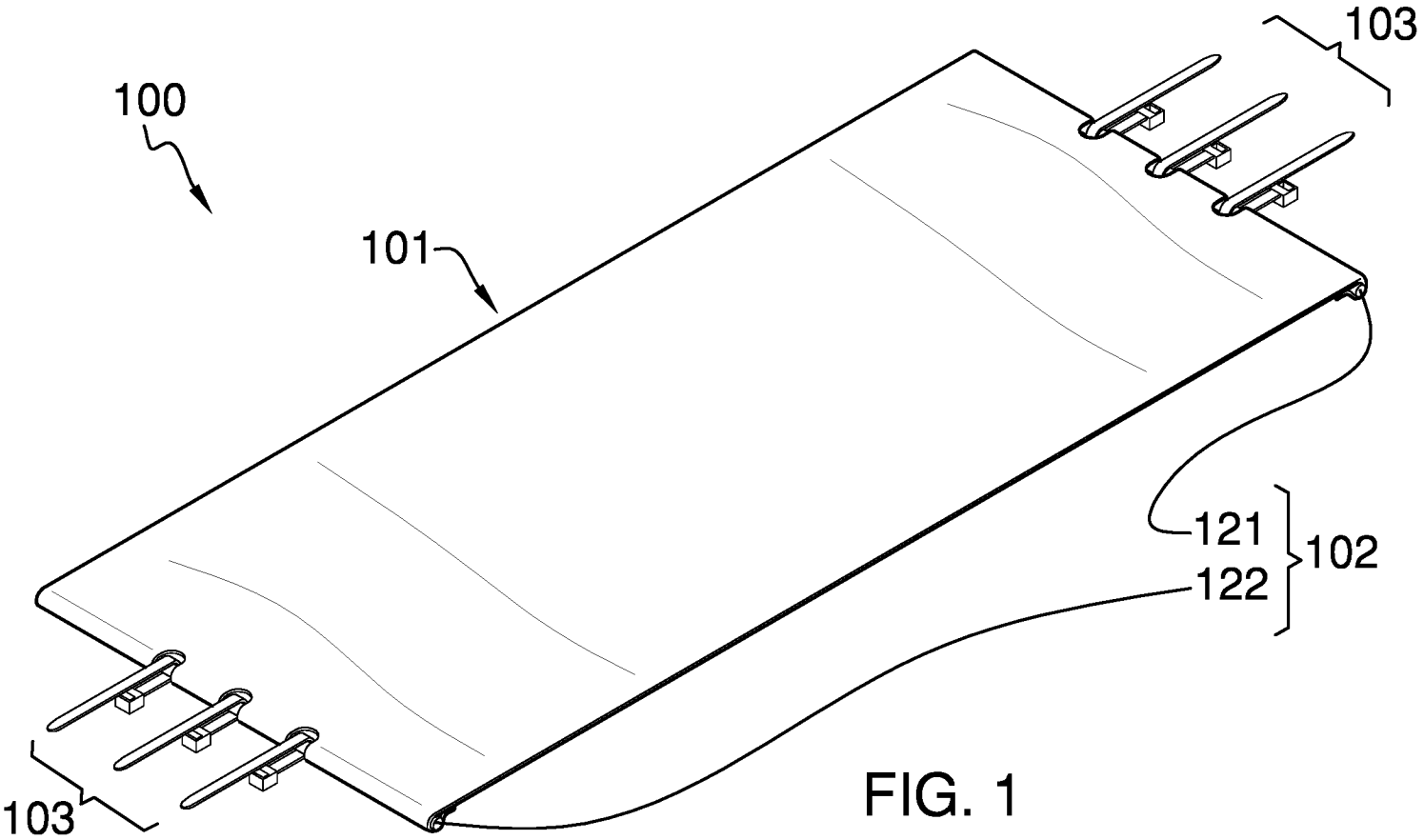
FIG. 1 is a perspective view of an embodiment of the disclosure.
Figure 2:
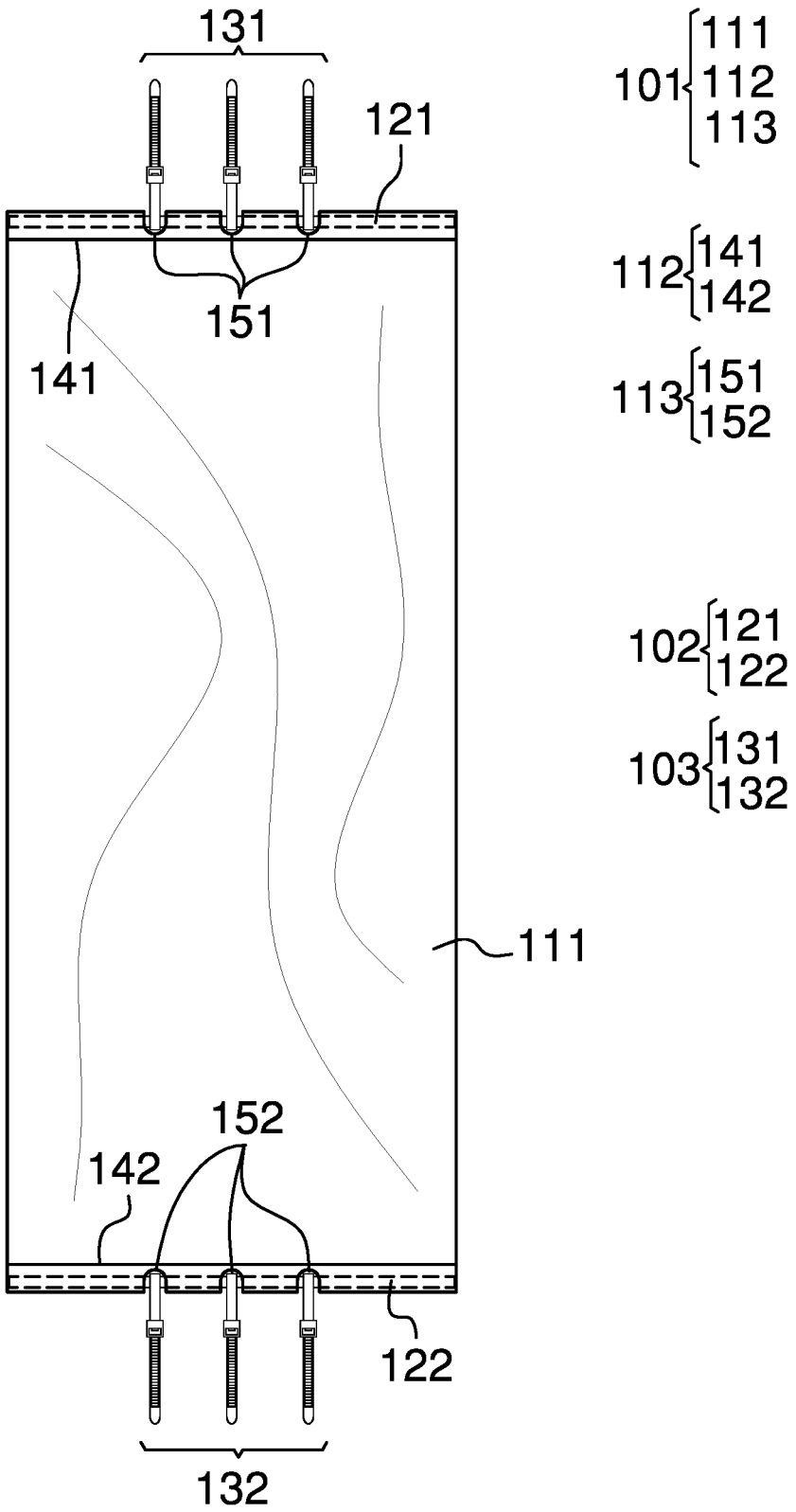
FIG. 2 is a top view of an embodiment of the disclosure.
Figure 3:
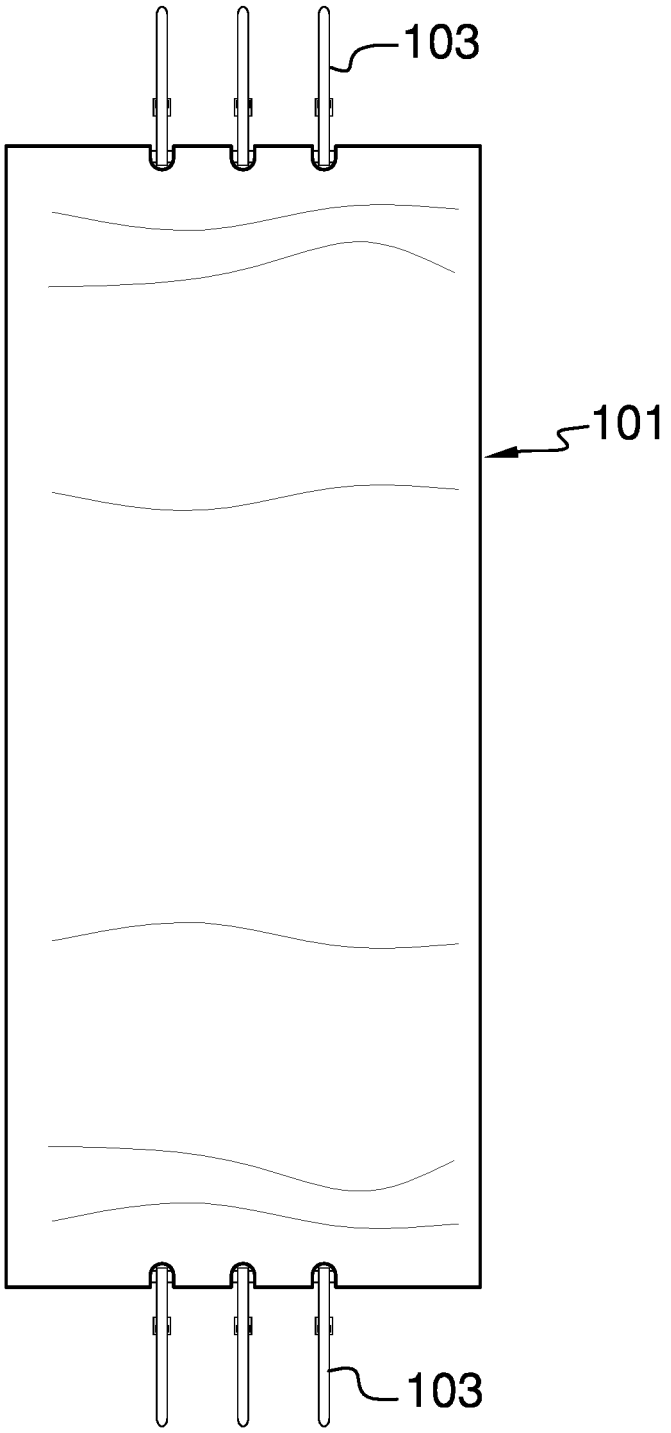
FIG. 3 is a bottom view of an embodiment of the disclosure.
Figure 4:
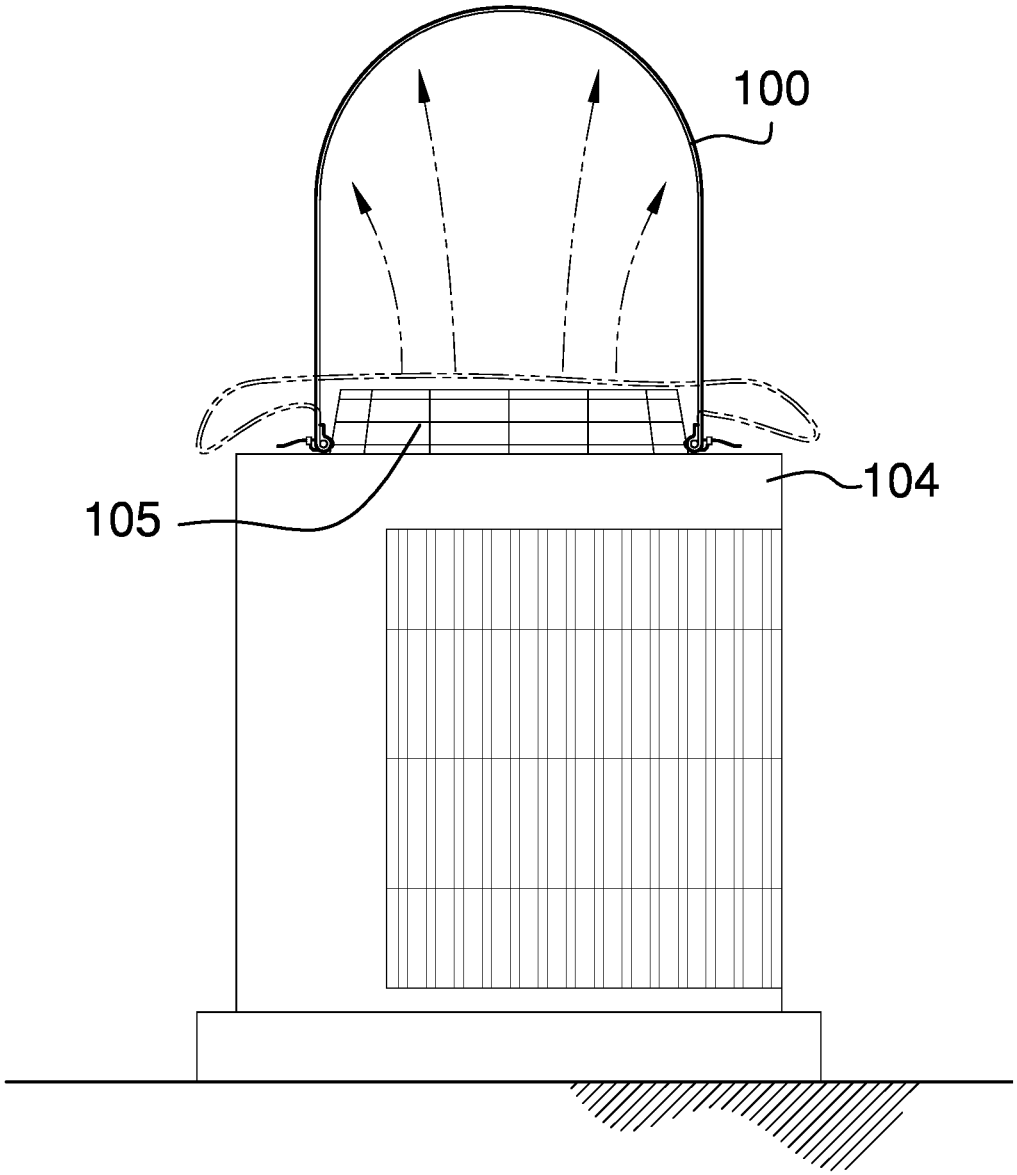
FIG. 4 is an in-use view of an embodiment of the disclosure.

Detailed reference will now be made to one or more potential embodiments of the disclosure, which are illustrated in FIGS. 1 through 4.

The air conditioning condenser cover 100 (hereinafter invention) comprises a barrier structure 101, a plurality of weight shafts 102, a plurality of fastening device sets 103, and an air conditioner 104. The air conditioner 104 further comprises an exhaust vent 105. The plurality of weight shafts 102 and the plurality of fastening device sets 103 attach the barrier structure 101 to the exhaust vent 105 of the air conditioner 104. The barrier structure 101 forms a protected space that prevents water and debris from entering the exhaust vent 105 of the air conditioner 104.

The air conditioner 104 is a mechanical device. The air conditioner 104 maintains a stable air temperature within one or more chambers in a building. The air conditioner 104 maintains a temperature that is lower than the temperature of the air that is outside of the building. The air conditioner 104 further comprises an exhaust vent 105. The exhaust vent 105 is an opening that is formed in the superior surface of the air conditioner 104. The air conditioner 104 discharges a flow of air out of the air conditioner 104 of the exhaust vent 105.

The barrier structure 101 is a mechanical structure. The barrier structure 101 is a flexible structure. The barrier structure 101 mounts on the air conditioner 104. The barrier structure 101 forms a protective barrier that encloses the exhaust vent 105 of the air conditioner 104 when the air conditioner 104 is not pumping exhaust air through the exhaust vent 105. When an air flow is generated through the exhaust vent 105 of the air conditioner 104 the force of the mass of the air discharged through the exhaust vent 105 displaces the barrier structure 101 to generate a flow path that allows the exhaust to escape from the invention 100. The barrier structure 101 comprises a sheeting structure 111, a plurality of rouleaux 112, and a plurality of grommet sets 113.

The sheeting structure 111 is a sheeting. The sheeting structure 111 is a disk shaped structure. The sheeting structure 111 is a flexible structure. The sheeting structure 111 forms the protective barrier that encloses the exhaust vent 105 of the air conditioner 104. The sheeting structure 111 creates the protected space that protects the exhaust vent 105 from water and debris.

Each rouleau selected from the plurality of rouleaux 112 is formed in the sheeting structure 111. Each rouleau selected from the plurality of rouleaux 112 is a rouleau that is formed in the sheeting structure 111. The rouleau is defined elsewhere in this disclosure. Each rouleau selected from the plurality of rouleaux 112 is sized to receive a weight shaft selected from the plurality of weight shafts 102. The plurality of rouleaux 112 secures the selected weight shaft to the sheeting structure 111. The plurality of rouleaux 112 further comprises a first rouleau 141 and a second rouleau 142.

The first rouleau 141 is a rouleau that is formed in an edge of the perimeter of the sheeting structure 111. The first rouleau 141 receives the first weight shaft 121 such that the first rouleau 141 secures the first weight shaft 121 to the sheeting structure 111. The second rouleau 142 is a rouleau that is formed in an edge of the perimeter of the sheeting structure 111. The second rouleau 142 receives the second weight shaft 122 such that the second rouleau 142 secures the second weight shaft 122 to the sheeting structure 111.

Each grommet contained in any grommet set selected from the plurality of grommet sets 113 is a ring that mounts through the faces of the disk structure of the sheeting structure 111. Each grommet contained in any grommet set selected from the plurality of grommet sets 113 forms a negative space through the faces of the disk structure of the sheeting structure 111. Each grommet contained in any grommet set selected from the plurality of grommet sets 113 forms an anchor point that allows a fastening device set selected from the plurality of fastening device sets 103 to secure the sheeting structure 111 to the air conditioner 104. The plurality of grommet sets 113 further comprises a first grommet set 151 and a second grommet set 152.

The first grommet set 151 comprises a collection of grommets. Each grommet selected from the first grommet set 151 forms an anchor point that allows a fastening device selected from the plurality of fastening device sets 103 to secure the selected grommet to the air conditioner 104. The second grommet set 152 comprises a collection of grommets. Each grommet selected from the second grommet set 152 forms an anchor point that allows a fastening device selected from the plurality of fastening device sets 103 to secure the selected grommet to the air conditioner 104.

Each of the plurality of weight shafts 102 is a prism shaped structure. Each of the plurality of weight shafts 102 is identical. Each of the plurality of weight shafts 102 is a high density structure. Each of the plurality of weight shafts 102 attaches to the barrier structure 101. Each of the plurality of weight shafts 102 rests on the superior surface of the air conditioner 104. The mass of each of the plurality of weight shafts 102 prevents the barrier structure 101 from shifting position relative to the exhaust vent 105 of the air conditioner 104. The plurality of weight shafts 102 comprises a first weight shaft 121 and a second weight shaft 122.

The first weight shaft 121 is a prism shaped structure. The first weight shaft 121 is formed from a high density material. The first weight shaft 121 is formed from a high density material. The first weight shaft 121 is sized such that the first weight shaft 121 inserts into the first rouleau 141 selected from the plurality of rouleaux 112 of the barrier structure 101. The first weight shaft 121 rests on the superior surface of the air conditioner 104. The first weight shaft 121 forms a ballast that secures the barrier structure 101 to the air conditioner 104.

The second weight shaft 122 is a prism shaped structure. The second weight shaft 122 is formed from a high density material. The second weight shaft 122 is formed from a high density material. The second weight shaft 122 is sized such that the second weight shaft 122 inserts into the second rouleau 142 selected from the plurality of rouleaux 112 of the barrier structure 101. The second weight shaft 122 rests on the superior surface of the air conditioner 104. The second weight shaft 122 forms a ballast that secures the barrier structure 101 to the air conditioner 104.

Each of the plurality of fastening device sets 103 is a fastening device. Each fastening device selected from the plurality of fastening device sets 103 attaches to a grommet selected from a grommet set selected from the plurality of grommet sets 113. Each fastening device selected from the plurality of fastening device sets 103 attaches the selected grommet to the air conditioner 104. The plurality of fastening device sets 103 comprises a first fastening device set 131 and a second fastening device set 132.

The first fastening device set 131 comprises a collection of fastening devices. The fastening devices contained in the first fastening device set 131 are identical. There is a one to one correspondence between the first fastening device set 131 and the first grommet set 151 such that each fastening device selected from the first fastening device set 131 is associated with a grommet selected from the first grommet set 151. Each selected fastening device secures its associated grommet to the air conditioner 104. In the first potential embodiment of the disclosure, each fastening device selected from the first fastening device set 131 is a cable tie.

The second fastening device set 132 comprises a collection of fastening devices. The fastening devices contained in the second fastening device set 132 are identical. There is a one to one correspondence between the second fastening device set 132 and the second grommet set 152 such that each fastening device selected from the second fastening device set 132 is associated with a grommet selected from the second grommet set 152. Each selected fastening device secures its associated grommet to the air conditioner 104. In the first potential embodiment of the disclosure, each fastening device selected from the second fastening device set 132 is a cable tie.

The following definitions were used in this disclosure:

Air Conditioner: As used in this disclosure, an air conditioner is a mechanical device. The air conditioner maintains a stable air temperature within one or more chambers in a building. The air conditioner is designed to maintain a temperature that is lower than the temperature of the air that is outside of the building.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Atmosphere: As used in this disclosure, the atmosphere refers to a blanket of gases (primarily nitrogen and oxygen) that surround the earth. Typical atmospheric conditions are approximated and characterized as the normal temperature and pressure. Atmospheric gases are commonly called air.

Ballast: As used in this disclosure, ballast refers to an inert and heavy subcomponent of a structure that: a) lowers the center of mass of the structure; and, b) stabilizes the structure so that the structure is difficult to move or rotate.

Barrier: As used in this disclosure, a barrier is a physical obstacle that forms a boundary between a first space and a second space. The barrier prevents the passage of an object between the first space and the second space.

Cable Tie: As used in this disclosure, a cable tie is a type of fastener that is used to tie two objects together. The cable tie has a box end and an open end. The box end further comprises a gear like structure wherein when the open end is inserted into the gear like structure, the gear like structure acts as a ratchet that prevents the open end from being removed from the gear like structure.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Density: As used in this disclosure, density is a measured property of a structure that equals the mass of the structure divided by the volume of the structure. The term specific gravity is commonly used to compare the different densities of two different structure. The specific gravity is calculated as the ratio of the two densities of the two different structure. The term high density refers to a structure that has a density greater than or equal to 2.0 grams per cubic centimeter (2000 kg/cubic meter).

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Eyelet: As used in this disclosure, an eyelet is a ring shaped mechanical structure intended to reinforce and protect the edges of an aperture.

Fastener: As used in this disclosure, a fastener is a device that is used to join or affix a first object to a second object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grommet: As used in this disclosure, a grommet is an eyelet placed in a hole in a textile, sheet, or panel that protects a rope hook or cable passed through it and to protect the textile, sheet, or panel from being torn.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

HVAC: As used in this disclosure, HVAC is an acronym for Heating Ventilation and Air Conditioning and is a general term that refers to the air handling technology used within a structure.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mass: As used in this disclosure, refers to a quantity of matter within a structure. Mass is measured and quantified by the reaction of the structure to a force. Mass can also be roughly quantified as a function of atomic composition and the number of atoms contained within the structure. The term weight refers to the quantification of a mass that is exposed to the force of gravity.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains an environment suitable within the protected space that is appropriate for the object; or, c) protects the object within the protected space from potential dangers that are outside of the protected space.

Rouleau: As used in this disclosure, a rouleau is a tube or channel that is formed on the edge of a textile or sheeting. The plural of rouleau is rouleaux.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Textile: As used in this disclosure, a textile is a material that is woven, knitted, braided, or felted. Synonyms in common usage for this definition include fabric and cloth. The two surfaces of the textile with the greatest surface area are called the faces of the textile.

Vent: As used in this disclosure, a vent is an opening in a structure that allows for the flow of gas through the boundary of the structure.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An air conditioning condenser cover comprising a barrier structure, a plurality of weight shafts, a plurality of fastening device sets, and an air conditioner;

wherein the air conditioner further comprises an exhaust vent;

wherein the plurality of weight shafts and the plurality of fastening device sets attach the barrier structure to the exhaust vent of the air conditioner;

wherein the barrier structure forms a protected space that prevents water and debris from entering the exhaust vent of the air conditioner;

wherein the exhaust vent is an opening that is formed in a superior surface of the air conditioner;

wherein the air conditioner discharges a flow of air out of the air conditioner of the exhaust vent;

wherein each of the plurality of fastening device sets is a fastening device;

wherein each fastening device selected from the plurality of fastening device sets attaches to a grommet selected from a grommet set selected from the plurality of grommet sets;

wherein each fastening device selected from the plurality of fastening device sets attaches the selected grommet to the air conditioner;

wherein the barrier structure comprises a sheeting structure, a plurality of rouleaux, and a plurality of grommet sets;

wherein each rouleau selected from the plurality of rouleaux is sized to receive a weight shaft selected from the plurality of weight shafts;

wherein the plurality of rouleaux secures the selected weight shaft to the sheeting structure;

wherein each of the plurality of weight shafts is a prism shaped structure;

wherein each of the plurality of weight shafts is identical;

wherein each of the plurality of weight shafts is a high density structure;

wherein each of the plurality of weight shafts attaches to the barrier structure;

wherein each of the plurality of weight shafts rests on the superior surface of the air conditioner;

wherein the mass of each of the plurality of weight shafts prevents the barrier structure from shifting position relative to the exhaust vent of the air conditioner;

wherein the barrier structure is a mechanical structure;

wherein the barrier structure is a flexible structure;

wherein the barrier structure mounts on the air conditioner;

wherein the barrier structure forms a protective barrier that encloses the exhaust vent of the air conditioner when the air conditioner is not pumping exhaust air through the exhaust vent;

wherein when an air flow is generated through the exhaust vent of the air conditioner the force of the mass of the air discharged through the exhaust vent displaces the barrier structure to generate a flow path that allows the exhaust to escape from the air conditioning condenser cover.

2. The air conditioning condenser cover according to claim 1 wherein each rouleau selected from the plurality of rouleaux is formed in the sheeting structure;

wherein each grommet contained in any grommet set selected from the plurality of grommet sets is a ring that mounts through the faces of the disk structure of the sheeting structure.

3. The air conditioning condenser cover according to claim 2 wherein the sheeting structure is a sheeting;

wherein the sheeting structure is a disk shaped structure;

wherein the sheeting structure is a flexible structure;

wherein the sheeting structure forms the protective barrier that encloses the exhaust vent of the air conditioner;

wherein the sheeting structure creates the protected space that protects the exhaust vent from water and debris.

4. The air conditioning condenser cover according to claim 3 wherein each grommet contained in any grommet set selected from the plurality of grommet sets forms a negative space through the faces of the disk structure of the sheeting structure;

wherein each grommet contained in any grommet set selected from the plurality of grommet sets forms an anchor point that allows a fastening device set selected from the plurality of fastening device sets to secure the sheeting structure to the air conditioner.

5. The air conditioning condenser cover according to claim 4 wherein the plurality of rouleaux further comprises a first rouleau and a second rouleau;

wherein the first rouleau is a rouleau that is formed in an edge of the perimeter of the sheeting structure;

wherein the first rouleau receives the first weight shaft such that the first rouleau secures the first weight shaft to the sheeting structure;

wherein the second rouleau is a rouleau that is formed in an edge of the perimeter of the sheeting structure;

wherein the second rouleau receives the second weight shaft such that the second rouleau secures the second weight shaft to the sheeting structure.

6. The air conditioning condenser cover according to claim 5 wherein the plurality of grommet sets further comprises a first grommet set and a second grommet set;

wherein the first grommet set comprises a collection of grommets;

wherein each grommet selected from the first grommet set forms an anchor point that allows a fastening device selected from the plurality of fastening device sets to secure the selected grommet to the air conditioner;

wherein the second grommet set comprises a collection of grommets;

wherein each grommet selected from the second grommet set forms an anchor point that allows a fastening device selected from the plurality of fastening device sets to secure the selected grommet to the air conditioner.

7. The air conditioning condenser cover according to claim 6 wherein the plurality of weight shafts comprises a first weight shaft and a second weight shaft;

wherein the first weight shaft is a prism shaped structure;

wherein the first weight shaft is formed from a high density material;

wherein the first weight shaft is sized such that the first weight shaft inserts into the first rouleau selected from the plurality of rouleaux of the barrier structure;

wherein the first weight shaft rests on the superior surface of the air conditioner;

wherein the first weight shaft forms a ballast that secures the barrier structure to the air conditioner;

wherein the second weight shaft is a prism shaped structure;

wherein the second weight shaft is formed from a high density material;

wherein the second weight shaft is sized such that the second weight shaft inserts into the second rouleau selected from the plurality of rouleaux of the barrier structure;

wherein the second weight shaft rests on the superior surface of the air conditioner;

wherein the second weight shaft forms a ballast that secures the barrier structure to the air conditioner.

8. The air conditioning condenser cover according to claim 7 wherein the plurality of fastening device sets comprises a first fastening device set and a second fastening device set;

wherein the first fastening device set comprises a collection of fastening devices;

wherein the fastening devices contained in the first fastening device set are identical;

wherein there is a one to one correspondence between the first fastening device set and the first grommet set such that each fastening device selected from the first fastening device set is associated with a grommet selected from the first grommet set;

wherein each selected fastening device secures its associated grommet to the air conditioner;

wherein the second fastening device set comprises a collection of fastening devices;

wherein the fastening devices contained in the second fastening device set are identical;

wherein there is a one to one correspondence between the second fastening device set and the second grommet set such that each fastening device selected from the second fastening device set is associated with a grommet selected from the second grommet set;

wherein each selected fastening device secures its associated grommet to the air conditioner.

* * * * *